US007611228B2

(12) United States Patent
Onozawa

(10) Patent No.: US 7,611,228 B2
(45) Date of Patent: Nov. 3, 2009

(54) MIST EJECTION HEAD AND IMAGE FORMING APPARATUS COMPRISING SAME

(75) Inventor: Sho Onozawa, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 404 days.

(21) Appl. No.: 11/717,671

(22) Filed: Mar. 14, 2007

(65) Prior Publication Data

US 2007/0216730 A1 Sep. 20, 2007

(30) Foreign Application Priority Data

Mar. 15, 2006 (JP) ..... 2006-071551

(51) Int. Cl.
*B41J 2/06* (2006.01)

(52) U.S. Cl. ..... 347/55; 347/68

(58) Field of Classification Search ..... 347/44, 347/46, 47, 54, 55, 68, 70, 71, 72
See application file for complete search history.

(56) References Cited

U.S. PATENT DOCUMENTS 5,992,978 A 11/1999 Fujii et al.
6,036,301 A * 3/2000 Amemiya et al. ..... 347/46
6,213,590 B1 4/2001 Fujii et al.
6,371,598 B1 4/2002 Fujii et al.
6,655,769 B2 * 12/2003 Sawano ..... 347/5
2002/0063751 A1 5/2002 Aizawa et al.

FOREIGN PATENT DOCUMENTS

JP 62-85948 A 4/1987
JP 62-111757 A 5/1987
JP 8-1952 A 1/1996
JP 2002-59549 A 2/2002
JP 2002-166541 A 6/2002

* cited by examiner

*Primary Examiner*—Juanita D Stephens
(74) *Attorney, Agent, or Firm*—Birch, Stewart, Kolasch & Birch, LLP

(57) ABSTRACT

The mist ejection head includes: a nozzle which ejects liquid; a nozzle plate which has electrical conductivity and in which the nozzle is formed; a liquid chamber connected to the nozzle; an ultrasonic wave generating element which generates an ultrasonic wave applied to the liquid in a vicinity of the nozzle; and an electrode which is provided on a wall of the liquid chamber other than the nozzle plate, wherein an electric field applied between the nozzle plate and the electrode is controlled.

20 Claims, 13 Drawing Sheets

MIST EJECTION HEAD AND IMAGE FORMING APPARATUS COMPRISING SAME

BACKGROUND OF THE INVENTION

1. Field of the Invention

The present invention relates to a mist ejection head and an image forming apparatus, and more particularly, to a mist ejection head and an image forming apparatus for liquid having high viscosity.

2. Description of the Related Art

Japanese Patent Application Publication Nos. 62-85948, 62-111757, 2002-59549, and 2002-166541 each disclose a liquid ejection apparatus which ejects fine liquid droplets in the form of a mist.

The ejection of mist is performed by creating a mist of the liquid by means of an ultrasonic wave. More specifically, in general, atomization caused by cavitation (hollowing), or atomization caused by capillary surface waves, are used. If the latter type of method is used, then it is possible to generate a mist of uniform particle size and the energy efficiency is good.

In a case where a planar wave is applied toward the free liquid surface according to the method of the capillary wave atomization, provided that the frequency of the ultrasonic wave (planar wave) and the amplitude (onset amplitude) of the ultrasonic wave on the free surface of the liquid (the liquid-atmosphere interface, which is also commonly called "meniscus") satisfy particular conditions relating to the properties of the liquid, then the surface tension wave at the meniscus of the liquid oscillates in a time series. Consequently, very small liquid droplets (mist) break away from the wave peaks of the surface tension wave at the free surface of the liquid, at certain time points.

However, in a mist ejection head in the related art which ejects mist of this kind, as indicated by the capillarity number which is the ratio between the viscosity of the liquid and the capillary effect, it is, in principle, difficult to eject liquid of high viscosity. Even when an ultrasonic wave generating element operates at 10 MHz or above, the viscosity limit for generating a mist is 2 to 3 cP.

SUMMARY OF THE INVENTION

The present invention has been contrived in view of the foregoing circumstances, an object thereof being to provide a mist ejection head and an image forming apparatus whereby a mist can be ejected even in the case of a liquid of high viscosity, for example, a liquid having a viscosity of approximately 10 to 30 cP.

In order to attain the aforementioned object, the present invention is directed to a mist ejection head comprising: a nozzle which ejects liquid; a nozzle plate which has electrical conductivity and in which the nozzle is formed; a liquid chamber connected to the nozzle; an ultrasonic wave generating element which generates an ultrasonic wave applied to the liquid in a vicinity of the nozzle; and an electrode which is provided on a wall of the liquid chamber other than the nozzle plate, wherein an electric field applied between the nozzle plate and the electrode is controlled.

In this aspect of the present invention, even in the case of a liquid of high viscosity, it is possible to raise the apparent surface tension and it is possible to generate and eject mist having little variation in the liquid droplet diameter.

In order to attain the aforementioned object, the present invention is also directed to a mist ejection head comprising: a nozzle which ejects liquid; a nozzle plate which has electrical conductivity and in which the nozzle is formed; a liquid chamber connected to the nozzle; an ultrasonic wave generating element which generates an ultrasonic wave applied to the liquid in a vicinity of the nozzle; and an electrode which is provided on a wall of the liquid chamber across the liquid in the liquid chamber from the nozzle plate, wherein an electric field applied between the nozzle plate and the electrode is controlled.

In this aspect of the present invention, even in the case of a liquid of high viscosity, it is possible to raise the apparent surface tension and it is possible to generate and eject mist having little variation in the liquid droplet diameter.

In order to attain the aforementioned object, the present invention is also directed to a mist ejection head comprising: a nozzle which ejects liquid; a nozzle plate which has electrical conductivity and in which the nozzle is formed; a liquid chamber connected to the nozzle; an ultrasonic wave generating element which is disposed on a lateral wall of the liquid chamber that makes contact with the nozzle plate and which generates an ultrasonic wave applied to the liquid in the liquid chamber; a reflector which has electrical conductivity and has a reflecting surface which reflects the ultrasonic wave transmitted toward a center of the liquid chamber from the ultrasonic wave generating element so as to concentrate the ultrasonic wave at a focal point located in a vicinity of the nozzle, wherein an electric field applied between the nozzle plate and the reflector is controlled.

In this aspect of the present invention, an ultrasonic wave is generated in the liquid in the liquid chamber by an ultrasonic wave generating element disposed on the lateral wall of the liquid chamber, and the ultrasonic wave is concentrated at a focal point in the vicinity of the nozzle through the reflecting surface of the reflector. Therefore, the ultrasonic wave arriving at the focal point is almost completely constituted by a reflected wave, the effects of the direct wave on the reflected wave concentrated at the focal point are eliminated, and consequently the energy efficiency is improved. Moreover, since the reflector also serves as an electrode, it is not necessary to provide an electrode separately.

Preferably, a cross-sectional shape of the reflecting surface of the reflector is constituted by two parabolas having a confocal point which coincides with the focal point.

In this aspect of the present invention, the cross-sectional shape of the reflecting surface of the reflector is constituted by two parabolas having a confocal point, and therefore the reflected wave is concentrated efficiently at the confocal point. Moreover, by using the reflector to serve also as an electrode, it is not necessary to provide an electrode separately.

Preferably, the liquid chamber has a cylindrical shape having an axis passing through the focal point; and the reflecting surface has a protrusion shape which is formed by rotating a parabola having a central axis perpendicular to the axis of the liquid chamber, around the axis of the liquid chamber.

In this aspect of the present invention, the liquid chamber has a cylindrical shape; the reflector has a rotational shape rotated about the axis of the liquid chamber; and a protrusion shape having a reflective surface formed by rotating a parabola having a central axis perpendicular to the axis of the liquid chamber, about the axis of the liquid chamber. Therefore, the direct wave is eliminated reliably, and a mist ejection head having extremely high efficiency in concentrating the reflected wave can be manufactured readily. Moreover, by using the reflector to serve also as an electrode, it is not necessary to provide an electrode separately.

Preferably, the electric field applied between the nozzle plate and the electrode is an alternating electric field.

Preferably, the electric field applied between the nozzle plate and the reflector is an alternating electric field.

In these aspects of the present invention, even in the case of a liquid of high viscosity, it is possible to raise the apparent surface tension yet further and it is possible to generate and eject mist having little variation in the liquid droplet diameter.

Preferably, a frequency of the alternating electric field is ½ of a frequency at which the ultrasonic wave generating element is driven.

In this aspect of the present invention, even in the case of a liquid of high viscosity, it is possible to raise the apparent surface tension yet further and it is possible to generate and eject a mist having little variation in the liquid droplet diameter.

Preferably, when a meniscus surface of the liquid in the nozzle has a protrusion shape in which the meniscus surface projects from a surface of the nozzle plate in terms of a liquid ejection direction, the nozzle plate and the electrode are charged in such a manner that the nozzle plate and the electrode have opposite polarities.

Preferably, when a meniscus surface of the liquid in the nozzle has a protrusion shape in which the meniscus surface projects from a surface of the nozzle plate in terms of a liquid ejection direction, the nozzle plate and the reflector are charged in such a manner that the nozzle plate and the reflector have opposite polarities.

In these aspects of the present invention, even in the case of a liquid of high viscosity, it is possible to increase the apparent surface tension, when the meniscus surface of the liquid in the nozzle has become a protrusion shape (e.g. convex shape) with respect to the surface of the nozzle plate in the liquid ejection direction. Accordingly, it is possible to generate and eject a mist having little variation in the liquid droplet diameter.

Preferably, when a meniscus surface of the liquid in the nozzle has a recess shape in which the meniscus surface retreats with respect to a surface of the nozzle plate in terms of a liquid ejection direction, the nozzle plate and the electrode are charged in such a manner that the nozzle plate and the electrode have a same polarity.

Preferably, when a meniscus surface of the liquid in the nozzle has a recess shape in which the meniscus surface retreats with respect to a surface of the nozzle plate in terms of a liquid ejection direction, the nozzle plate and the reflector are charged in such a manner that the nozzle plate and the reflector have a same polarity.

In these aspects of the present invention, even in the case of a liquid of high viscosity, it is possible to increase the apparent surface tension, when the meniscus surface of the liquid in the nozzle has become a recess shape (e.g. concave shape) with respect to the surface of the nozzle plate in the liquid ejection direction, and it is possible to generate and eject a mist having little variation in the liquid droplet diameter.

In order to attain the aforementioned object, the present invention is also directed to an image forming apparatus comprising any one of the mist ejection heads described above.

In this aspect of the present invention, it is possible to obtain a high-definition image forming apparatus which is capable of generating a very fine mist having little variation in the liquid droplet diameter, even in the case of a liquid of high viscosity.

According to the present invention, even in the case of a liquid of high viscosity, it is possible to raise the apparent surface tension by applying a prescribed electric field, and it is possible to generate and eject mist having little variation in the liquid droplet diameter. Accordingly, it is possible to obtain an image of high definition and high quality using an ink mist, even in a case where a liquid of high viscosity is used as the ink.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

Principles of the Invention

Firstly, principles of an embodiment of the present invention are described below.

In the present embodiment, when the meniscus surface of the liquid in the vicinity of a nozzle is caused to vibrate by an ultrasonic wave generating element, an electric field is applied to the liquid (ink), and thereby the curvature radius of the meniscus surface of the liquid in the vicinity of the nozzle is increased. The apparent surface tension of the liquid is thus increased. Consequently, it is possible to reduce the capillarity number, and hence a uniform mist can be generated, even in the case of a liquid having high viscosity.

More specifically, the capillarity number (Ca) is represented by the following equation:

$$Ca=\mu V/\gamma,$$

where μ is the viscosity of the liquid, γ is the coefficient of surface tension of the liquid, and V is the speed of propagation of a surface tension wave. If this capillarity number Ca is greater than a specific value, then even when an ultrasonic wave generating element operates at 10 MHz or above, it is difficult to create a mist of the liquid. Therefore, in order to achieve a mist of the liquid, the capillarity number Ca should be made equal to or lower than the specific value.

Since a liquid having high viscosity has a high value for $\mu$, then the value of Ca become large, and this prevents the generation of a uniform mist. In the present embodiment, even if the value of $\mu$ is large, the value of $\gamma$ is increased in order to prevent the Ca value from being relatively large. For this purpose, an electric field is applied to the liquid in order to increase the value of $\gamma$ and thereby to raise the apparent surface tension.

Principles of the present embodiment are described below with reference to drawings.

Figure 1A:
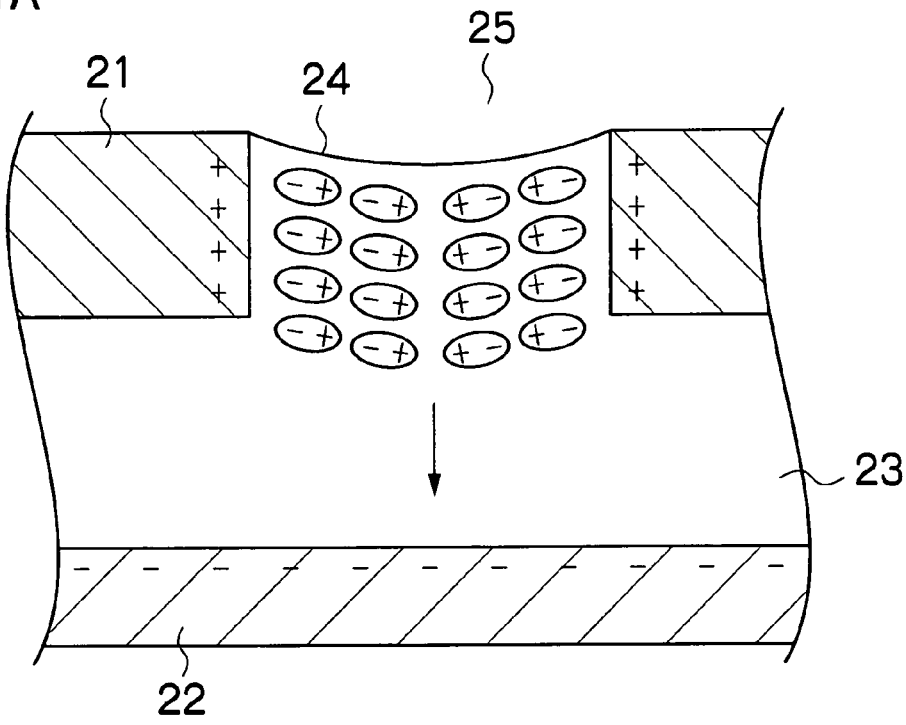
FIGS. 1A and 1B are illustrative diagrams showing principles of a mist ejection head according to an embodiment of the present invention.
Figure 1B:
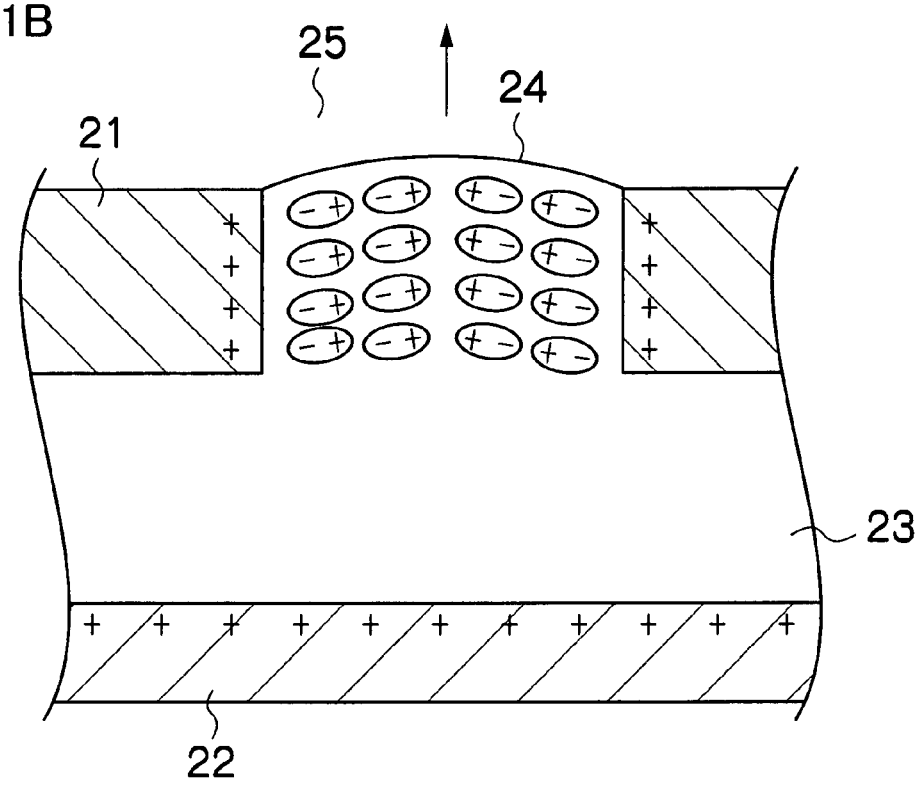

FIGS. 1A and 1B are conceptual diagrams for cases where an electric field is applied to liquid in a state where the liquid surface is stationary.

A liquid having polarity, such as water, is filled into a liquid chamber 23, a nozzle 25 is provided in a nozzle plate 21, and a liquid surface (meniscus surface) 24 is formed. The liquid chamber 23 is enclosed by the nozzle plate 21, a rear surface plate 22, and side plates (not illustrated).

FIG. 1A shows a case where an electric field is applied in such a manner that a positive charge is applied to the nozzle plate 21 and a negative charge is applied to the rear surface plate 22. Due to the positive charge applied to the nozzle plate 21, the liquid molecules having polarity are orientated in such a manner that their negative poles face the nozzle plate 21 (the negative poles face the periphery of the nozzle 25), and the positive poles of the liquid molecules having polarity face the center of the nozzle. In the center of the nozzle 25, liquid molecules collect with their positive poles facing the center of the nozzle 25. Therefore, by applying a negative charge to the rear surface plate 22, the positive poles of the liquid molecules in the central portion of the nozzle 25 are drawn toward the rear surface plate 22 of the negative charges. Accordingly, a downward force (a force in a downward direction in FIG. 1A) acts on the liquid molecules in the central portion of the nozzle 25, in other words, a force acts so as to cause the surface (the meniscus surface) 24 of the liquid in the vicinity of the nozzle 25 to assume a concave shape.

On the other hand, if, as shown in FIG. 1B, a positive charge is applied to the nozzle plate 21 and a positive charge is also applied to the rear surface plate 22, then there is a repulsion between the positive poles of the liquid molecules in the central portion of the nozzle 25 and the positive charge of the rear surface plate 22. Hence, an upward force (in terms of FIG. 1B) acts on the liquid molecules in the central portion of the nozzle 25, in other words, a force acts so as to cause the surface of the liquid in the vicinity of the nozzle (the meniscus surface) 24 to assume a convex shape.

For the purpose of the explanation, cases where a positive charge is applied to the nozzle plate 21 are described above, but the same applies to a case where a negative charge is applied to the nozzle plate 21. More specifically, by applying a negative charge to the nozzle plate 21 and a positive charge to the rear surface plate 22, then a downward force (in terms of the diagram) acts on the liquid surface 24. On the other hand, by applying a negative charge to the nozzle plate 21 and a negative charge to the rear surface plate also, an upward force (in terms of the diagram) acts on the liquid surface 24. In this case, the orientation of polarity of the liquid molecules is opposite to the orientation shown in FIGS. 1A and 1B.

Next, the relationship of forces during applying the vibration to the liquid in the vicinity of the nozzle with an ultrasonic wave generating element is described below with reference to FIGS. 2A to 2B.

Figure 2A:
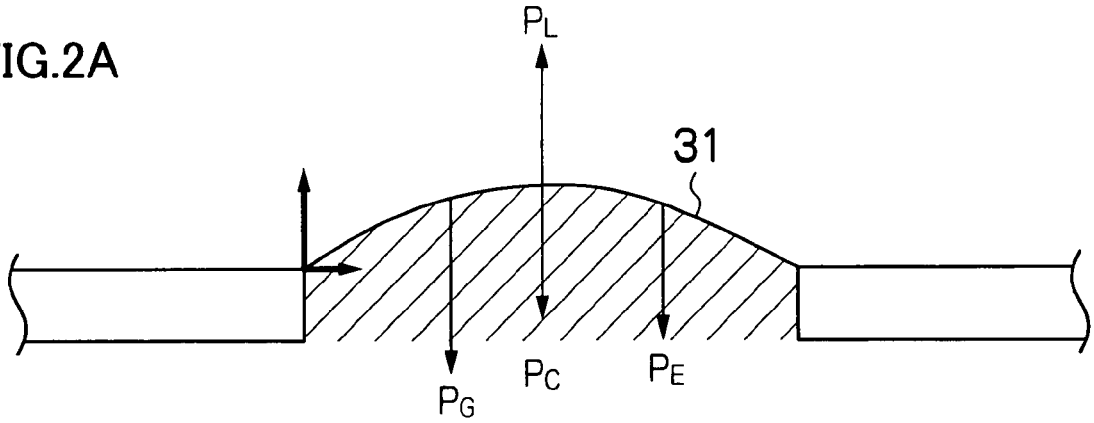
FIGS. 2A and 2B are diagrams showing the relationship of forces acting on the liquid surface in the vicinity of a nozzle.

FIG. 2A is a diagram showing a relationship among forces in a state where the liquid surface (meniscus surface) 31 in the vicinity of the nozzle has been changed to a convex shape by an ultrasonic wave generating element. When no electric field is applied to the liquid, the forces acting are "$P_G$: atmospheric pressure", "$P_L$: hydrostatic pressure", and "$P_C$: pressure of liquid surface tension". As shown in FIG. 2A, $P_G$ and $P_C$ act toward the inner side of the liquid (the downward direction in FIG. 2A), and $P_L$ acts toward the outer side of the liquid (the upward direction in FIG. 2A). In the present embodiment, even in the case of a liquid having high viscosity, by raising the surface tension, the capillarity number can be reduced and it is possible to create a uniform mist. Accordingly, an electric field is applied to the liquid in such a manner that a force (electrostatic force) acts in the same direction as $P_C$, which is the pressure of liquid surface tension.

More specifically, as shown in FIG. 1A, by applying a positive charge to the nozzle plate 21 and applying a negative charge to the rear surface plate 22, it is possible to make a downward force (in terms of the diagram) act on the liquid in the vicinity of the nozzle 25. Consequently, by applying the electric field as described above, it is possible to conform the direction of the electrostatic force to the direction in which the pressure of liquid surface tension acts.

By applying an electric field in this way, as shown in FIG. 2A, the forces $P_G$, $P_C$ and $P_E$ act in the inward direction of the liquid (in the downward direction in FIG. 2A), and hence the radius of curvature of the liquid surface becomes greater (the liquid surface approaches a flatter state), compared to a case where there is no force $P_E$. Thus, the apparent surface tension of the liquid can be increased.

Figure 2B:
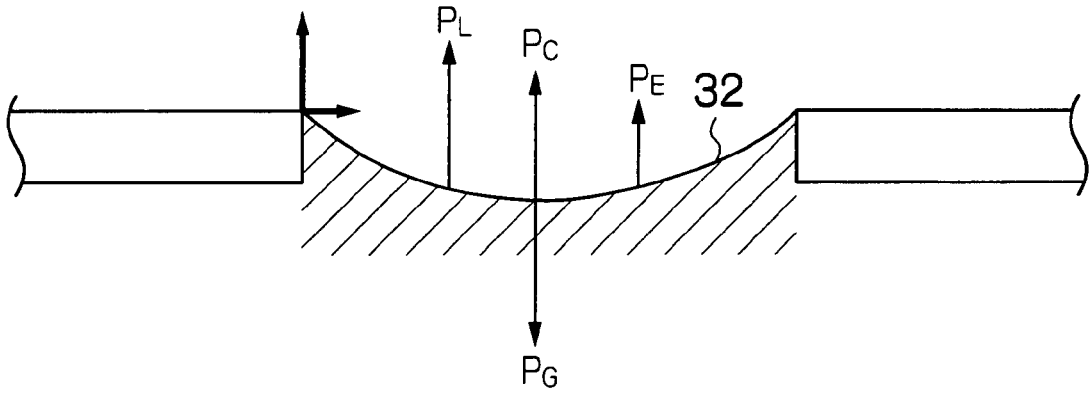

FIG. 2B is a diagram showing a relationship among forces in a state where the liquid surface (meniscus surface) 32 in the vicinity of the nozzle has been changed to a concave shape by an ultrasonic wave generating element. Similarly to FIG. 2A, when no electric field is applied to the liquid, the forces acting are "$P_G$: atmospheric pressure", "$P_L$: hydrostatic pressure", and "$P_C$: pressure of liquid surface tension". As shown in FIG. 2B, $P_G$ acts toward the inner side of the liquid (the downward direction in FIG. 2B), and $P_L$ and $P_C$ act toward the outer side of the liquid (the upward direction in FIG. 2B). Accordingly, an electric field is applied to the liquid in such a manner that an electrostatic force acts in the same direction as $P_C$, which is the pressure of liquid surface tension.

More specifically, as shown in FIG. 1B, by applying a positive charge to the nozzle plate 21 and also applying a positive charge to the rear surface plate 22, it is possible to make a force act on the liquid in the vicinity of the nozzle 25 so as to cause the liquid surface to move in the outward direction of the liquid (in the upward direction in the drawings), and hence the direction of this force can be conformed with the direction in which the pressure of liquid surface tension acts.

By applying an electric field in this way, as shown in FIG. 2B, the forces $P_L$, $P_C$ and $P_E$ act in the outward direction of the liquid (in the upward direction in the diagram), and hence the radius of curvature of the liquid surface becomes greater (the liquid surface approaches a flatter state) than that when there is no force of $P_E$. Consequently, the apparent surface tension of the liquid can be increased.

The meniscus surface of the liquid in the nozzle is caused to vibrate between a concave shape and a convex shape by means of the ultrasonic wave generating element. In this case, electric fields are applied to the liquid in accordance with this vibration, in other words, the charge of the rear surface plate 22 shown in FIGS. 1A and 1B is switched between positive and negative in accordance with the concave vibrational shape or convex vibrational shape of the liquid surface. Thereby, it is possible to increase the apparent surface tension of the liquid. Consequently, even if the liquid has high viscosity, it is possible to create a mist by means of an ultrasonic wave of approximately 10 MHz generated by the ultrasonic wave generator.

More specifically, a negative charge is applied to the rear surface plate when the liquid surface in the nozzle has been changed to a convex shape (protrusion shape) by the ultrasonic wave generating element. On the other hand, a positive charge is applied to the rear surface plate when the liquid surface in the nozzle has been changed to a concave shape (recess shape). Thereby, it is possible to increase the apparent surface tension of the liquid continuously, and consequently, it is possible to generate a highly uniform mist even in the case of a liquid of high viscosity.

Composition of Mist Ejection Head

A mist ejection head according to a first embodiment of the present invention based on the above-mentioned principles is described below with reference to FIGS. 3A and 3B.

Figure 3A:
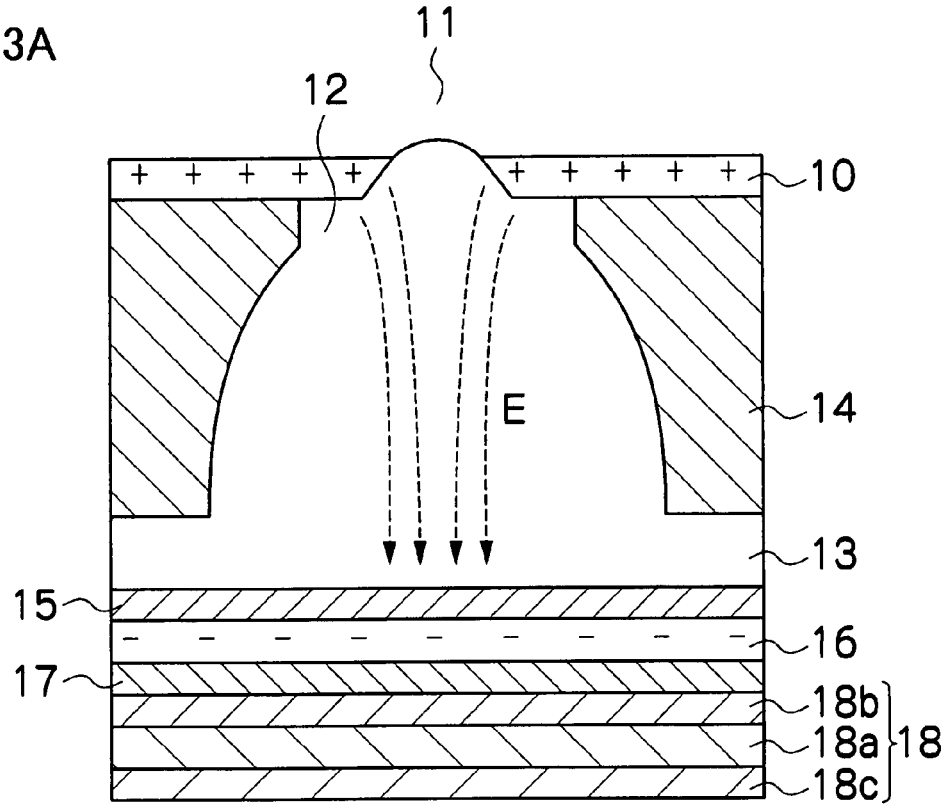
FIGS. 3A and 3B are cross-sectional diagrams of a mist ejection head according to a first embodiment of the present invention.
Figure 3B:
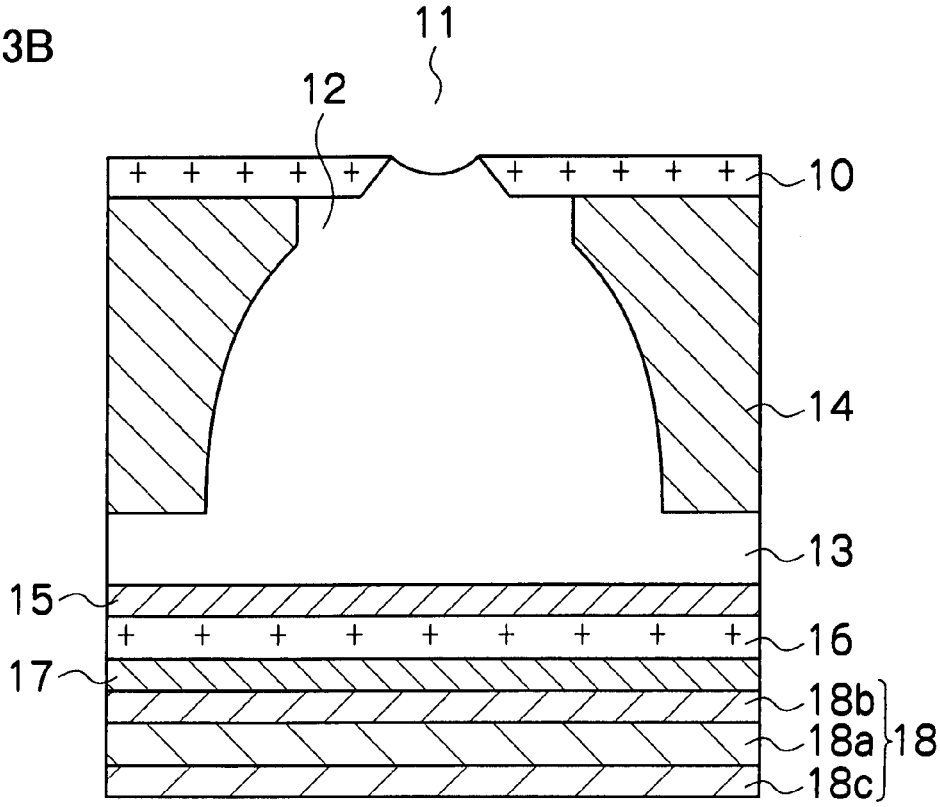

As shown in FIGS. 3A and 3B, the mist ejection head comprises: a nozzle plate 10 formed with a nozzle (ejection port) 11 which is an opening through which liquid is ejected; a liquid chamber 12 connected to the nozzle 11; a liquid supply port 13 which is an opening through which the liquid is supplied to the liquid chamber 12; a diaphragm 15 arranged at the bottom of the liquid chamber 12; a rear surface electrode layer (back electrode) 16, a separation layer 17, and an ultrasonic wave generating element 18 which are arranged on a side of the diaphragm 15 reverse to the other side facing the liquid chamber 12. The ultrasonic wave generating element 18 is an actuator capable of generating an ultrasonic wave and applying the ultrasonic wave to the liquid inside the liquid chamber 12.

The ultrasonic wave generating element 18 includes a piezoelectric body layer 18*a*, and upper and lower electrodes 18*b* and 18*c*. Drive signals are applied to the upper and lower electrodes 18*b* and 18*c* from outside the mist ejection head (more specifically, from a head driver 184 shown in FIG. 7, described hereinafter).

The liquid chamber 12 of the mist ejection head is defined by the nozzle plate 10 serving as the ceiling plate, the diaphragm 15 serving as the bottom plate, and partitions 14 serving as side plates.

In the ultrasonic wave generating element 18, the piezoelectric body layer 18*a* is made of lead zirconate titanate (PZT), and the upper and lower electrodes 18*b* and 18*c* are made of nickel (Ni). Moreover, the diaphragm 15 is made of polyimide (PI).

The ultrasonic waves generated by the ultrasonic wave generating element 18 are introduced into the liquid inside the liquid chamber 12 through the diaphragm 15, and the ultrasonic waves progress as parallel planar waves towards the nozzle plate 10. By means of these planar waves, surface tension waves are established on the free surface (meniscus) of the liquid in the nozzle 11. These surface tension waves are dependent on the surface tension of the liquid.

FIG. 3A shows a case where the meniscus surface in the nozzle 11 has been changed to a convex shape, by the ultrasonic wave generating element 18. In this case, an electric field is applied in such a manner that a positive charge is applied to the nozzle plate 10 and a negative charge is applied to the rear surface electrode layer 16, and consequently, as shown in FIGS. 1A and 2A, a force acts in a direction so that the liquid surface (meniscus surface) in the nozzle 11 approaches a planar shape (the curvature radius is increased).

FIG. 3B shows a case where the meniscus surface in the nozzle 11 has been changed to a concave shape, by the ultrasonic wave generating element 18. In this case, an electric field is applied in such a manner that a positive charge is applied to the nozzle plate 10 and a positive charge is applied to the rear surface electrode layer 16, and consequently, as shown in FIGS. 1B and 2B, a force acts in a direction so that the liquid surface (meniscus surface) in the liquid in the vicinity of the nozzle 11 approaches a planar shape (the curvature radius is increased).

The meniscus surface of the liquid in the nozzle 11 performs concave-convex vibration by means of the ultrasonic wave generating element 18. In cases of the liquid having high viscosity, the amplitude of the concave-convex vibration is very large. In the present embodiment, by altering the polarity of the electric field applied to the rear surface electrode layer 16 (by altering the direction of the electric field applied between the rear surface electrode layer 16 and the nozzle plate 10) in accordance with the concave or convex state of the meniscus surface of the liquid in the nozzle 11, it is possible to lower the amplitude of the concave-convex vibration of the meniscus surface of the liquid in the nozzle 11, and the surface tension can be increased. In general, the frequency of a surface tension wave is ½ of the frequency applied to the ultrasonic wave generating element 18. Therefore, the frequency of the alternating electric field applied to the rear surface electrode layer 16 is required to be ½ of the frequency applied to the ultrasonic wave generating element 18.

Next, a general structure embodiment of the mist ejection head is described below.

Figure 4:
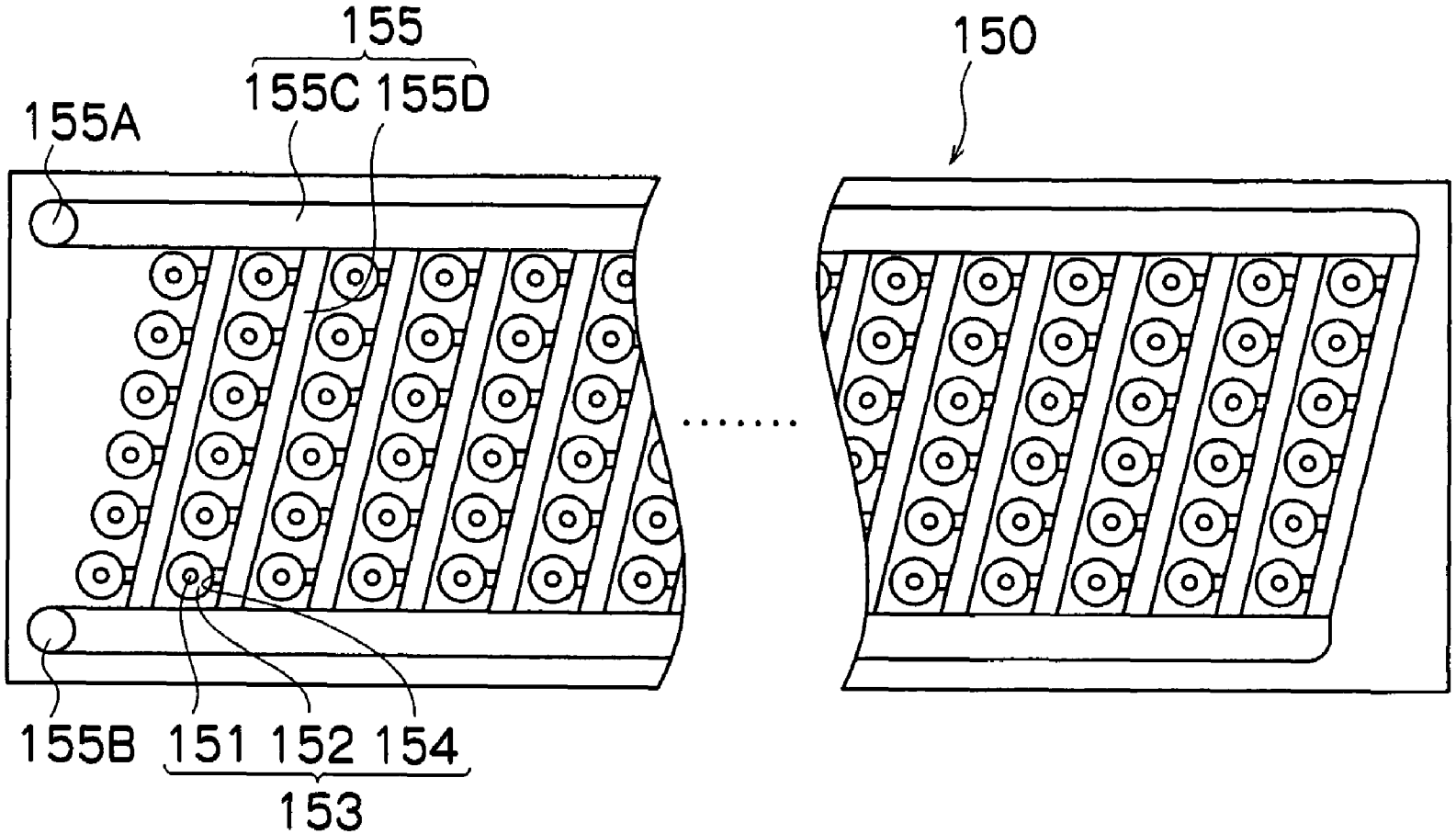
FIG. 4 is a plan view perspective diagram showing the overall structure of a concrete embodiment of the mist ejection head.

FIG. 4 is a plan view perspective diagram of an embodiment of the mist ejection head 150. As shown in FIG. 4, the mist ejection head 150 has a structure in which a plurality of ink chamber units (mist ejection elements) 153 are disposed in the form of a two-dimensional matrix. Each of the ink chamber units 153 includes a nozzle 151 forming an ink ejection port, an ink chamber 152 corresponding to the nozzle 151, and an individual supply channel 154. Hence the effective nozzle interval (the projected nozzle pitch) as projected in the lengthwise direction of the mist ejection head 150 (the direction perpendicular to the paper conveyance direction) is reduced and high nozzle density can be achieved. In FIG. 4, in order to simplify the drawing, some of the ink chamber units 153 are omitted from the drawing.

The ink chambers 152 are connected to common flow channels 155 through the individual supply channels 154. The common flow channels 155 are connected to an ink tank which forms an ink source (which is not shown in FIG. 4 and is equivalent to an ink storing and loading unit 114 shown in FIG. 8, which is described hereinafter) through connection ports 155A and 155B, and the ink supplied from the ink tank is distributed and supplied to the ink chambers 152 of the channels through the common flow channels 155 in FIG. 4. The reference numeral 155C in FIG. 4 indicates a main channel of the common flow channel 155, and 155D indicates a distributary channel which branches off from the main channel 155C.

To give a brief description of the correspondence of the mist ejection head 150 shown in FIG. 4 to the composition of the mist ejection head shown in FIGS. 3A and 3B, the nozzles 151, the liquid chambers 152 and the individual supply channels 154 in FIG. 4 correspond respectively to the nozzles 11, the liquid chambers 12 and the liquid supply ports 13 described with reference to FIGS. 3A and 3B.

Figure 5:
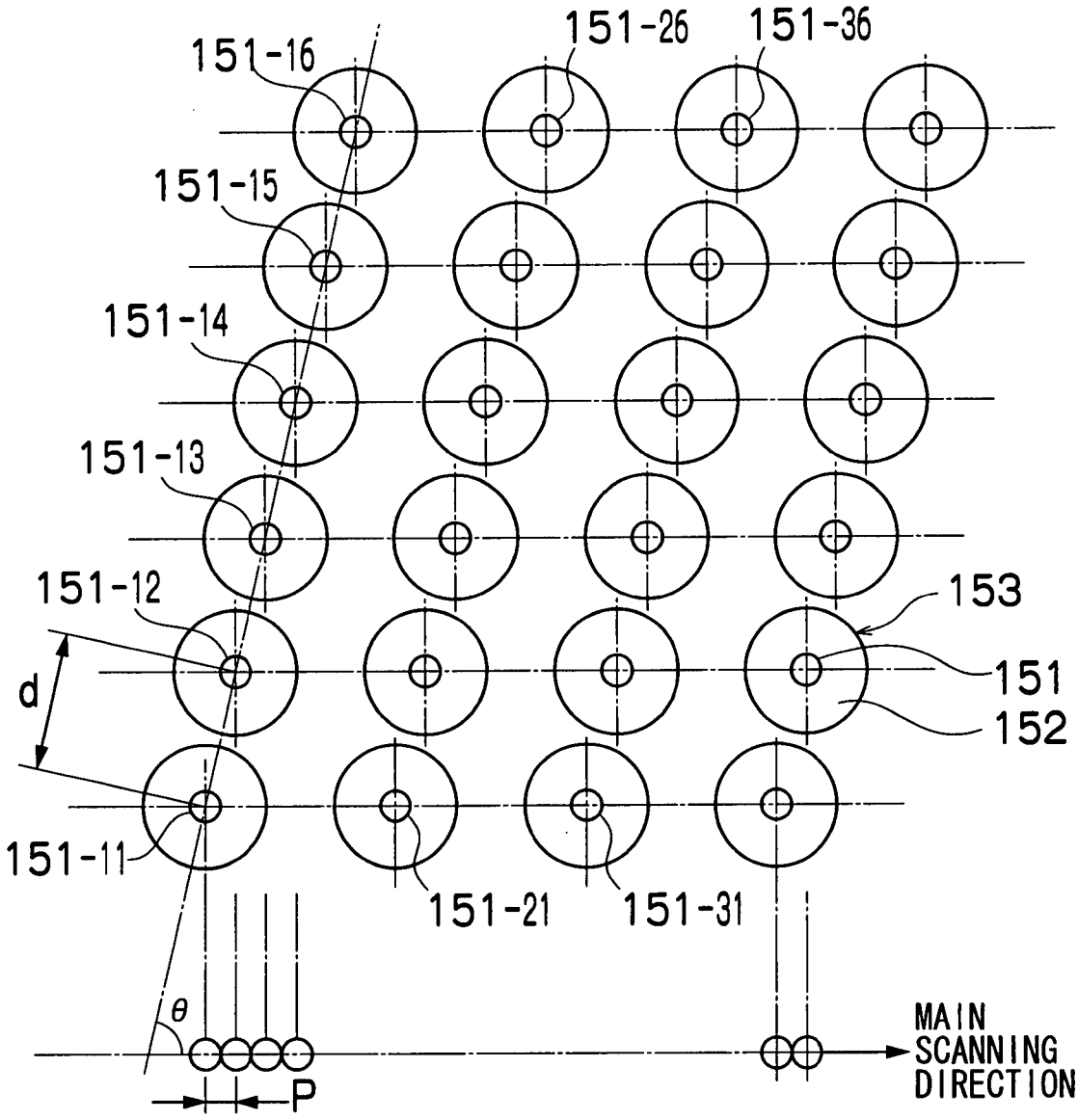
FIG. 5 is an enlarged diagram showing an enlarged view of a portion of FIG. 4.

FIG. 5 is a diagram showing an enlarged view of a portion of the print head 150 shown in FIG. 4. As shown in FIG. 5, the plurality of ink chamber units 153 are arranged in a lattice configuration in two directions: the main scanning direction and an oblique direction forming a prescribed angle of θ with respect to the main scanning direction. In other words, the plurality of nozzles 151 are arranged in a two-dimensional matrix configuration. By arranging the nozzles in a two-dimensional matrix of this kind, the effective nozzle density is increased to a high density.

More specifically, by arranging the plurality of ink chamber units 153 at a uniform pitch of d in the oblique direction forming the uniform angle of θ with respect to the main scanning direction, it is possible to treat the nozzles 151 as being equivalent to an arrangement of nozzles at a pitch P(=d×cos θ) in a straight line in the main scanning direction. Consequently, it is possible to achieve a composition which is substantially equivalent to a high-density nozzle arrangement of 2400 nozzles per inch in the main scanning direction.

Figure 6:
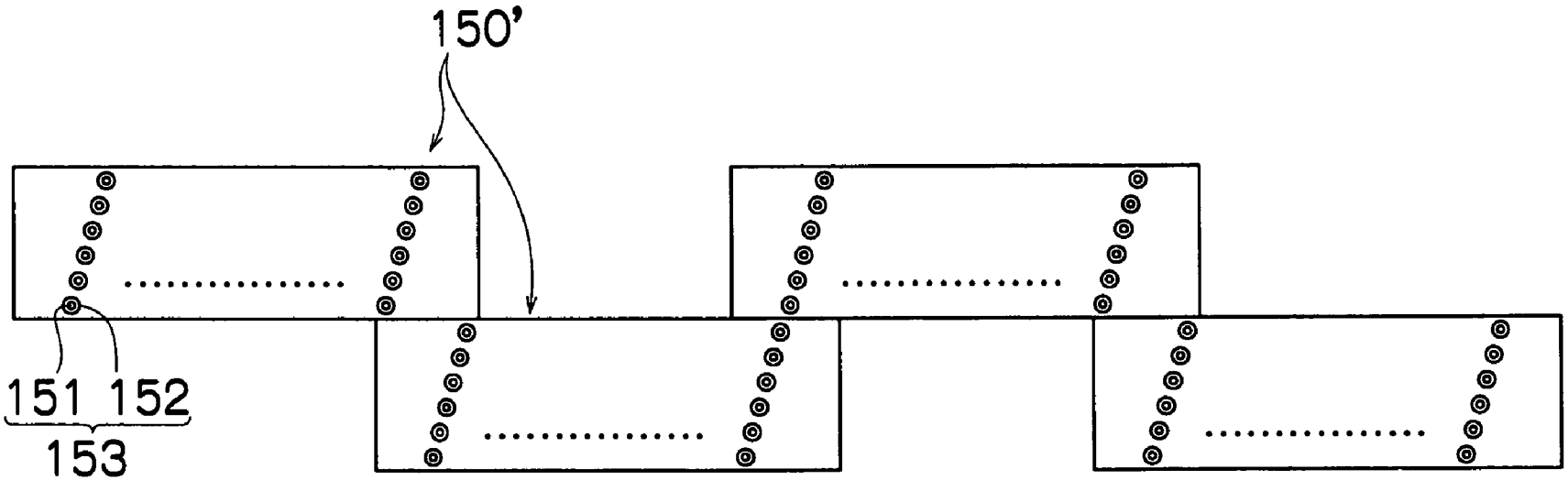
FIG. 6 is a plan view perspective diagram showing the overall structure of another concrete embodiment of the mist ejection head.

In implementing the present invention, the nozzle arrangement structure is not limited to the embodiment shown in FIGS. 4 and 5. For example, in one mode of a full line head which has a nozzle row extending through a length corresponding to the full width of the recording medium in a direction substantially perpendicular to the conveyance direction of the recording paper 116, instead of the composition shown in FIG. 5, it is possible to compose a line head having a nozzle row of a length corresponding to the full width of the recording medium by joining together, in a staggered matrix arrangement, a plurality of short head blocks 150', each comprising a plurality of nozzles 151 arranged in a two-dimensional configuration, as shown in FIG. 6, for instance.

Description of Control System

Figure 7:
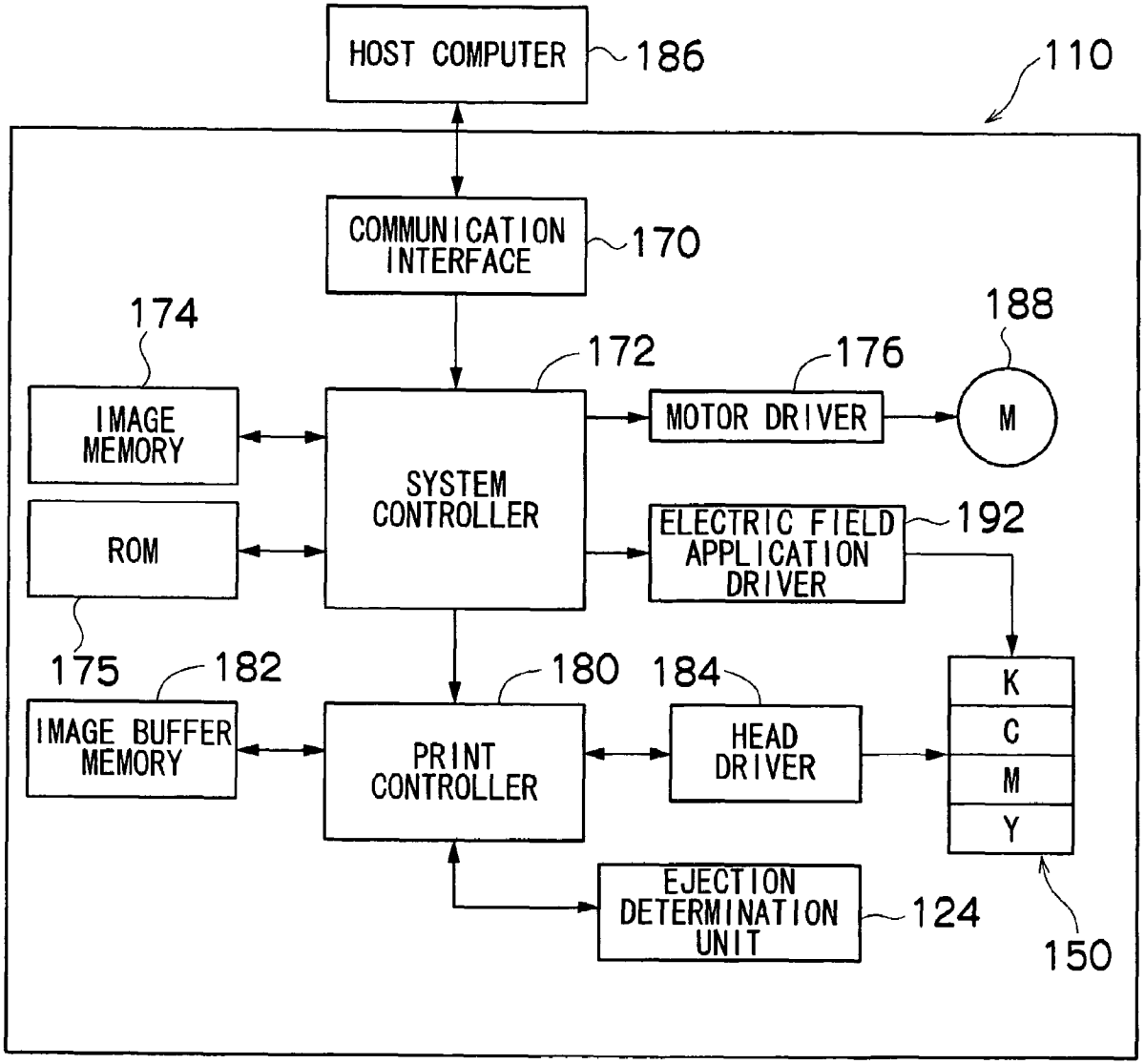
FIG. 7 is a block diagram showing an approximate view of the general composition of an image forming apparatus according to an embodiment of the present invention.

FIG. 7 is a block diagram showing the system configuration embodiment of the image forming apparatus 110. As shown in FIG. 7, the image forming apparatus 110 comprises a communication interface 170, a system controller 172, an image memory 174, a ROM 175, a motor driver 176, a print controller 180, an image buffer memory 182, a head driver 184, an electric field application driver 192, and the like.

The communication interface 170 is an image input device for receiving image data sent from a host computer 186. A wired interface such as USB (universal serial bus), IEEE1394, Ethernet, or wireless network, may be used as the communication interface 170.

The image data sent from the host computer 186 is received by the image forming apparatus 110 through the communication interface 170, and is temporarily stored in the image memory 174.

The system controller 172 is constituted by a central processing unit (CPU) and peripheral circuits thereof, and the like, and controls the whole of the image forming apparatus 110 in accordance with a prescribed program. More specifically, the system controller 172 controls the various sections, such as the communication interface 170, image memory 174, motor driver 176, and the like, and controls communications with the host computer 186 and writing and reading to and from the image memory 174 and ROM 175. The system controller 172 also generates control signals for controlling a motor 188 of the conveyance system. The motor 188 of the conveyance system is a motor which applies a drive force to drive rollers of pairs of conveyance rollers 131 and 133 shown in FIG. 8, for example.

Programs executed by the CPU of the system controller 172 and the various types of data which are required for control procedures are stored in the ROM 175. The ROM 175 may be a non-rewriteable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate signals for controlling ink ejection, from the image data in the image memory 174, and it supplies the data (dot data) thus generated to the head driver 184.

The ejection determination unit 124 includes an image sensor (line sensor or area sensor) for capturing an image of the ejection results of the mist ejection head 150, and it functions as a device for checking for ejection defects, such as nozzle blockages or displacement of the depositing position of the ejected liquid, on the basis of the image read out by the image sensor.

The print controller 180 is provided with the image buffer memory 182; and image data, parameters, and other data are temporarily stored in the image buffer memory 182 when image is processed in the print controller 180. The aspect shown in FIG. 7 is one in which the image buffer memory 182 accompanies the print controller 180; however, the image memory 174 may also serve as the image buffer memory 182. Also possible is an aspect in which the print controller 180 and the system controller 172 are integrated to form a single processor.

To give a general description of the sequence of processing from image input to image formation, image data to be formed is inputted from an external source through the communication interface 170, and is accumulated in the image memory 174. At this stage, RGB image data is stored in the image memory 174, for example.

In this image forming apparatus 110, an image which appears to have a continuous tonal graduation to the human eye is formed by changing the density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. The dot data generated by the print controller 180 in this way is stored in the image buffer memory 182.

The head driver 184 outputs drive signals for driving the ultrasonic wave generating elements 18 (shown in FIGS. 3A and 3B) corresponding to the respective nozzles 151 of the mist ejection head 150, on the basis of the dot data supplied by the print controller 180 (in other words, the dot data stored in the image buffer memory 182). A feedback control system for maintaining uniform driving conditions in the mist ejection head may also be incorporated into the head driver 184.

By supplying the drive signals outputted by the head driver 184 to the mist ejection head 150, the liquid is ejected from the corresponding nozzles 151. By controlling ink ejection from the mist ejection head 150 in synchronization with the conveyance speed of the recording medium, a prescribed image is formed on the recording medium.

The electric field application driver 192 controls the application of the electric field between the nozzle plate 10 and the back electrode 16 as described with reference to FIGS. 3A and 3B, or between a nozzle plate 510 and a reflector 80 described below with reference to FIGS. 13A and 13B.

Figure 8:
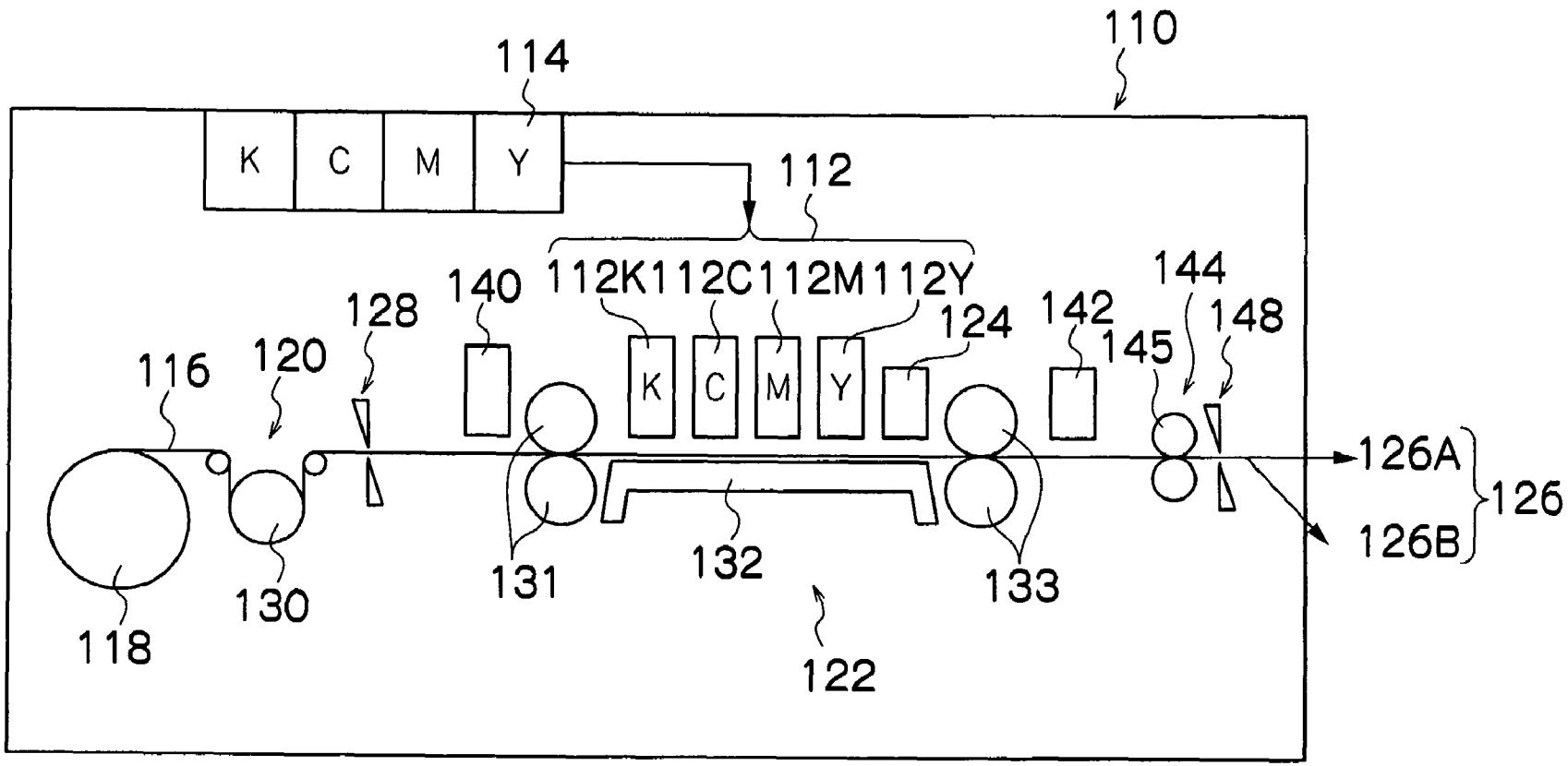
FIG. 8 is a general compositional diagram showing the functional composition of an image forming apparatus.

FIG. 8 is a general schematic drawing showing an approximate view of an embodiment of the functional composition of the image forming apparatus 110. The image forming apparatus 110 shown in FIG. 8 comprises: a mist ejection unit 112 having a plurality of mist ejection heads (hereinafter, called "heads") 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a conveyance unit 122, disposed facing the nozzle face (ink ejection face) of the mist ejection unit 112, for conveying the recording paper 116 while keeping the recording paper 116 flat; an ejection determination unit 124 for reading the ejection result produced by the mist ejection unit 112; and a paper output unit 126 for outputting recorded recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels.

In FIG. 8, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine.

In the case of the configuration in which roll paper is used, a cutter (first cutter) 128 is provided as shown in FIG. 8, and the continuous paper is cut into a desired size by the cutter 128. When cut papers are used, the cutter 128 is not required.

After the decurling, the cut recording paper 116 is nipped and conveyed by the pair of conveyance rollers 131, and is placed onto a platen 132. A pair of conveyance rollers 133 is also disposed on the downstream side of the platen 132 (the downstream side of the mist ejection unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode. The platen 132 in FIG. 8 has a width dimension which is greater than the width of the recording paper 116, and at least the portion of the platen 132 opposing the nozzle surface of the mist ejection unit 112 and the sensor surface of the ejection determination unit 124 is a horizontal surface (flat surface).

A heating fan 140 is provided in the conveyance path of the recording paper 116, on the upstream side of the mist ejection unit 112. This heating fan 140 blows heated air onto the recording paper 116 before ink is ejected onto the paper and thereby heats up the recording paper 116. Heating the recording paper 116 immediately before ink ejection has the effect of making the ink dry more readily after depositing on the paper.

Figure 9:
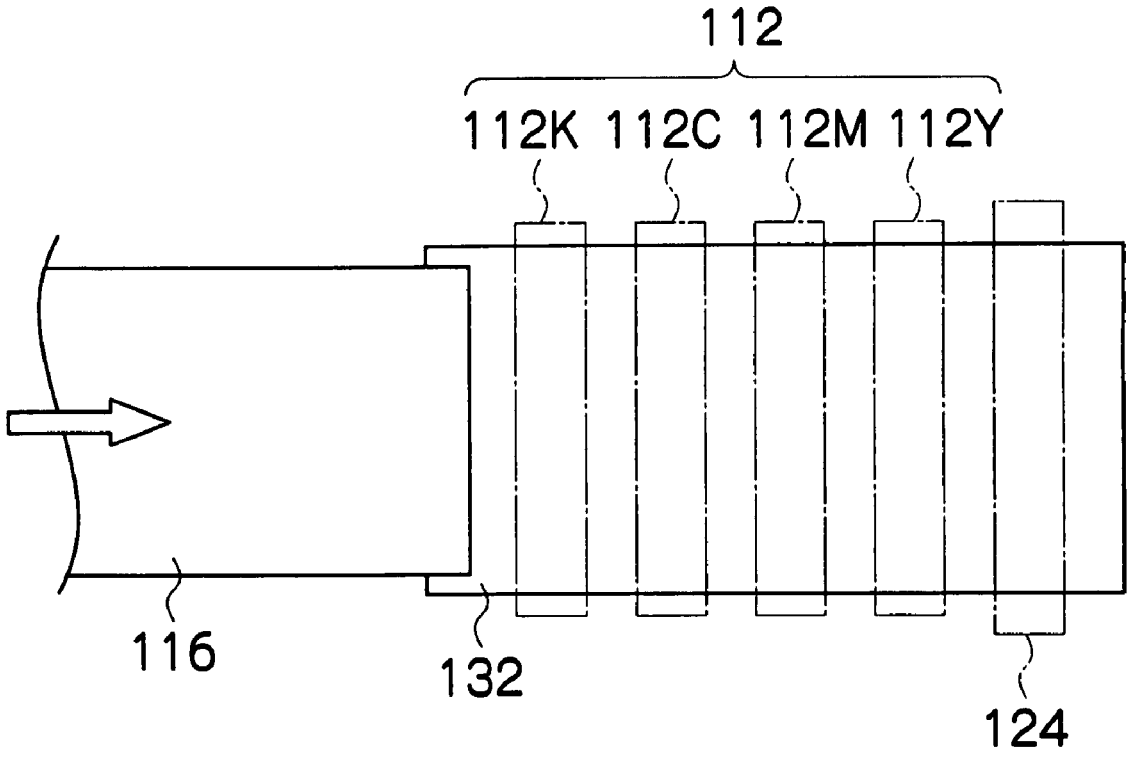
FIG. 9 is a principal plan diagram of the peripheral area of a mist ejection unit in the image forming apparatus in FIG. 8.

The mist ejection heads 112K, 112C, 112M and 112Y of the mist ejection unit 112 are full line type heads having a length corresponding to the maximum width of the recording paper 116 used with the image forming apparatus 110, and comprising a plurality of nozzles for ejecting ink arranged on a nozzle face through a length exceeding at least one edge of the maximum-size recording paper (namely, the full width of the printable range) (see FIG. 9).

The mist ejection heads 112K, 112C, 112M and 112Y are arranged in color order (black (K), cyan (C), magenta (M), yellow (Y)) from the upstream side in the feed direction of the recording paper 116, and each of the mist ejection heads 112K, 112C, 112M and 112Y is fixed extending in a direction substantially perpendicular to the conveyance direction of the recording paper 116.

A color image can be formed on the recording paper 116 by ejecting inks of different colors from the mist ejection heads 112K, 112C, 112M and 112Y, respectively, onto the recording paper 116 while the recording paper 116 is conveyed by the conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the mist ejection unit 112 in the paper conveyance direction (the sub-scanning direction), in other words, by means of a single sub-scanning action. Higher-speed printing is thereby made possible and productivity can be improved in comparison with a shuttle type head configuration in which a mist ejection head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which mist ejection heads for ejecting light-colored inks such as light cyan and light magenta are added. Furthermore, there are no particular restrictions of the sequence in which the mist ejection heads of respective colors are arranged.

A test pattern or the target image formed by the mist ejection heads 112K, 112C, 112M, and 112Y of the respective colors is read in by the ejection determination unit 124, and the ejection result is determined by the ejection determination unit 124.

A post-drying unit 142 is provided at a downstream stage from the ejection determination unit 124. The post-drying unit 142 is a device for drying the formed image surface, and it may comprise, for example, a heating fan.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test image are preferably outputted separately. In the image forming apparatus 110, a sorting device (not shown) is provided for switching the outputting pathways in order to sort the printed matter with the target print and the printed matter with the test image, and to send them to paper output units 126A and 126B, respectively. When the target print and the test image are simultaneously formed in parallel on the same large sheet of paper, the test image portion is cut and separated by a cutter (second cutter) 148. Although not shown in FIG. 8, the paper output unit 126A for the target prints is provided with a sorter for collecting prints according to print orders.

Next, a second embodiment of the present invention is described below.

In a mist ejection head according to the second embodiment of the present invention, an ultrasonic wave generating element is provided on the lateral face of a liquid chamber.

Firstly, the basic structure of the mist ejection head according to the second embodiment is described below.

Figure 10:
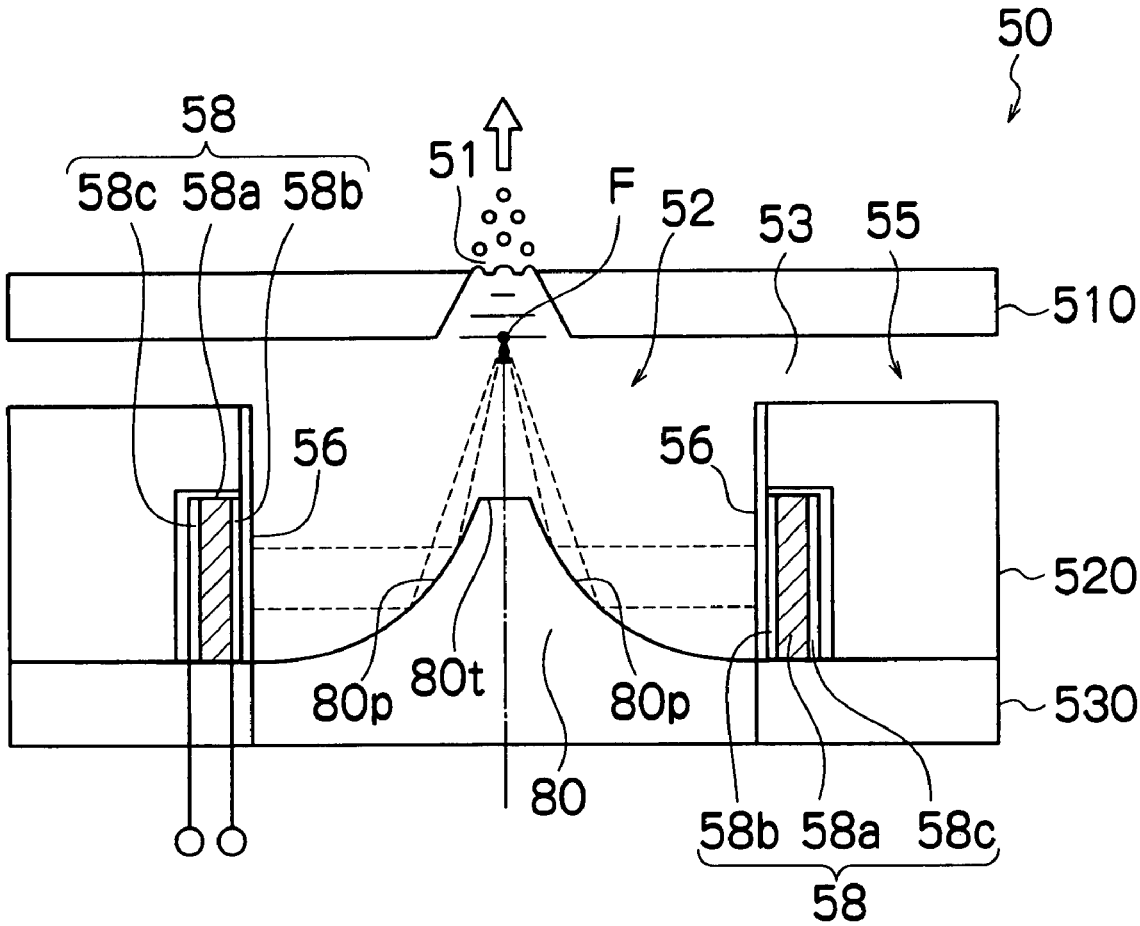
FIG. 10 is a cross-sectional diagram of a mist ejection head according to a second embodiment of the present invention.

FIG. 10 is a cross-sectional diagram showing the basic composition of a mist ejection head according to the second embodiment of the present invention. The mist ejection head 50 according to the present embodiment comprises: a nozzle 51 forming an opening section which ejects ink in the form of a mist; a liquid chamber 52 connected to the nozzle 51; an ink supply port 53 forming an opening section through which ink is supplied to the liquid chamber 52; a common liquid chamber 55 in which the ink to be supplied to the liquid chamber 52 via the ink supply port 53 flows; a diaphragm 56 which is disposed on the lateral wall of the liquid chamber 52 and which transmits ultrasonic waves generated by an ultrasonic wave generating element 58 to the liquid inside the liquid chamber 52; and a reflector 80 which reflects the ultrasonic waves from the ultrasonic wave generating element 58 and concentrates the waves at a focal point F situated in the vicinity of the nozzle 51 inside the liquid chamber 52.

The ultrasonic wave generating element 58 is constituted by a piezoelectric body 58*a*, an upper electrode 58*b* and a lower electrode 58*c* to which drive signals are applied.

The mist ejection head 50 a layer-stack structure in which a reflector plate 530 having a reflector 80, a liquid chamber plate 520 having an ultrasonic wave generating element 58 which is disposed in the lateral face of a liquid chamber 52, and a nozzle plate 510 having a nozzle 51 are stacked.

An ultrasonic wave generated by the ultrasonic wave generating element 58 disposed on the lateral wall of the liquid chamber 52 is transmitted to the liquid inside the liquid chamber 52 through the diaphragm 56 provided on the lateral wall of the liquid chamber 52. The ultrasonic wave then proceeds in a parallel fashion toward the center of the liquid chamber 52. In other words, the wave travels in a planar form in a direction perpendicular to the axis of this liquid chamber 52, in such a manner that it travels toward the axis of the liquid chamber 52 which passes through the focal point F.

The ultrasonic wave which progresses toward the axis of the liquid chamber 52 in this way is reflected at the paraboloidal surface 80*p* of the reflector 80. The focal point F of the paraboloidal surface 80*p* is situated in the vicinity of the nozzle 51 in the liquid chamber 52. The ultrasonic wave (reflected wave) which is reflected at the paraboloidal surface 80*p* of the reflector 80 travels toward the focal point F inside the liquid chamber 52, and is concentrated at the focal point F.

The direction in which the liquid is ejected in the form of a mist from the nozzle 51 (shown by the arrow in FIG. 10) is approximately the axis direction of the liquid chamber 52 which passes through the focal point F.

The cross-sectional shape of the paraboloidal surface 80*p* forming the reflecting surface of the reflector 80, and more specifically, the cross-sectional shape sectioned in a plane parallel to the direction of ejection passing through the focal point F, includes two parabolas having the same focal point F as a confocal point.

By means of a structure of this kind, it is possible to make the reflected wave concentrate efficiently at the focal point F. More specifically, the ultrasonic wave generated by the ultrasonic wave generating element 58 is introduced into the liquid inside the liquid chamber 52 through the diaphragm 56 on the lateral wall of the liquid chamber 52 and travels in a planar state toward the axis of the liquid chamber 52. The ultrasonic wave is then reflected obtusely (with an obtuse angle) by the paraboloidal surface 80*p* of the reflector 80. Thus, the ultrasonic wave is reflected with little loss of energy and is also concentrated with good efficiency at the focal point F.

The apex 80*t* of the reflector 80 (namely, the uppermost end section of the paraboloidal surface 80*p*) is adjusted in such a manner that the height of the apex 80*t* is the same as or higher than the height of the uppermost end of the ultrasonic wave generating element 58, which is disposed on the lateral wall 56 of the liquid chamber 52.

By means of a structure of this kind, the ultrasonic wave which has been generated by the ultrasonic wave generating element 58 and introduced into the liquid in the liquid chamber 52 through the diaphragm 56 on the lateral wall of the liquid chamber 52 and which has traveled in a planar state toward the axis of the liquid chamber 52, is not a direct wave, but rather, the ultrasonic wave arriving at the focal point F is a reflected wave in general. Therefore, adverse effects, such as attenuation and interference, are reduced and energy efficiency is improved.

Figure 11:
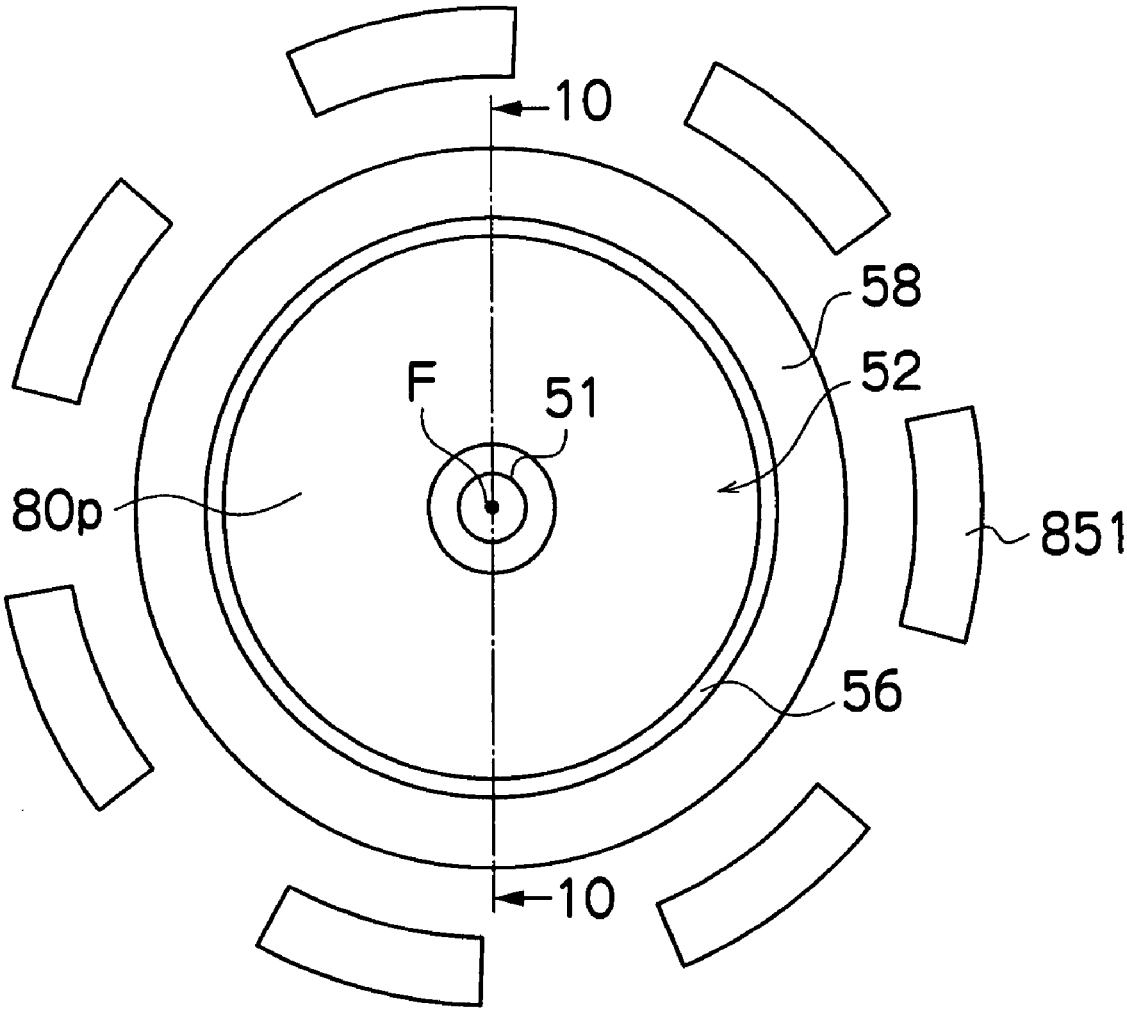
FIG. 11 is a plan view perspective diagram showing principal parts of the mist ejection head shown in FIG. 10.
Figure 12:
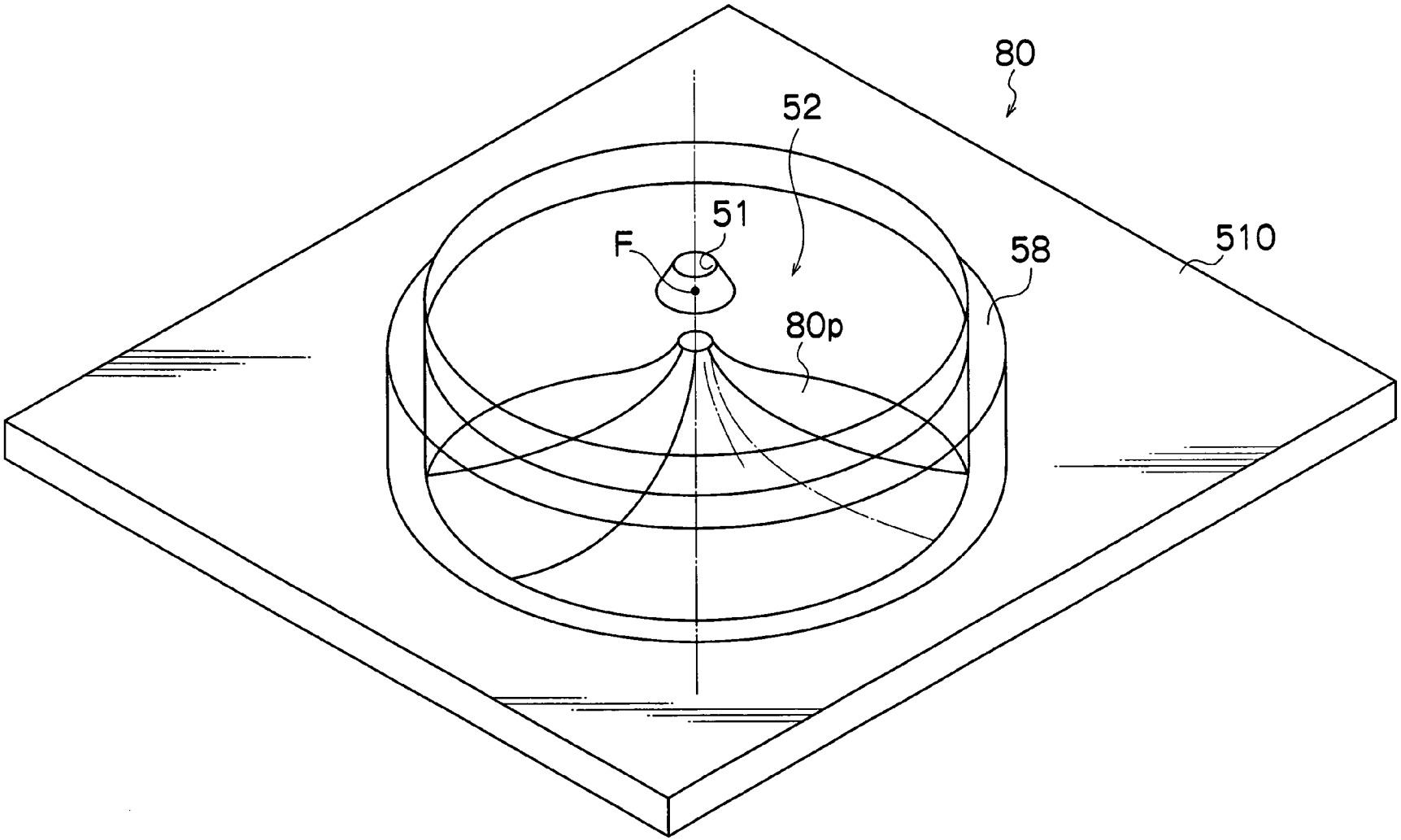
FIG. 12 is an oblique perspective diagram showing principal parts of the mist ejection head shown in FIG. 11.

In order to aid understanding of a preferable structure (a structure which maximizes the energy efficiency), FIG. 11 shows a plan view perspective diagram of a mist ejection head 50 having the basic composition shown in FIG. 10, and FIG. 12 shows an oblique perspective diagram which shows a schematic view of principal parts of the head. FIG. 10 shows a cross section along line 10-10 in FIG. 11.

In FIGS. 11 and 12, the liquid chamber 52 has a cylindrical shape having an axis passing through the focal point F. Furthermore, the reflector 80 has a protrusion shape. The paraboloidal surface 80*p* of the protrusion-shaped reflector 80 of this kind is formed by rotating a parabola having a central axis (symmetrical axis), about the axis of the liquid chamber 52. The central axis of the parabola constituting the paraboloidal surface 80*p* is an axis which is perpendicular to the axis of the liquid chamber 52 passing through the focal point F and which intersects with the axis of the liquid chamber 52 at the focal point F.

As shown in the horizontal cross section of FIG. 11, the nozzle plate 510 in which the nozzle 51 is formed and the liquid chamber plate 520 in which the liquid chamber 52 is formed are bonded together, via supporting columns 851 located outside the liquid chamber 52, and there are no connection points between the nozzle plate 510 and the liquid chamber plate 520 on the inner side of the liquid chamber 52. In this structure, air bubbles are not liable to collect about the perimeter of the nozzle 51, air bubble expulsion characteristics are improved, and ejection stability is improved, compared to a mist ejection head in the related art in which air bubbles are liable to occur at the corners of bonding sections between the nozzle plate 510 and the reflector.

FIGS. 10 to 12 show one liquid chamber unit corresponding to one nozzle 51 (a single mist spraying element). However, in the case of a mist ejection head which moves relatively with respect to such a recording medium as paper and forms an image on a recording medium, a structure in which a plurality of liquid chamber units are arranged one-dimensionally (line-shape) or in two-dimensionally (plane-shape) is adopted. In a mist ejection head of this kind, in practice, a plurality of nozzles 51 are formed in the nozzle plate 510, a plurality of liquid chambers 52 are formed in the liquid chamber plate 520, and an ultrasonic wave generating element 58 and a reflector 80 are provided for each of the liquid chambers 52.

In the mist ejection head according to the second embodiment having the basic structure described above, a case in which an electric field is applied to liquid is described more specifically.

Figure 13A:
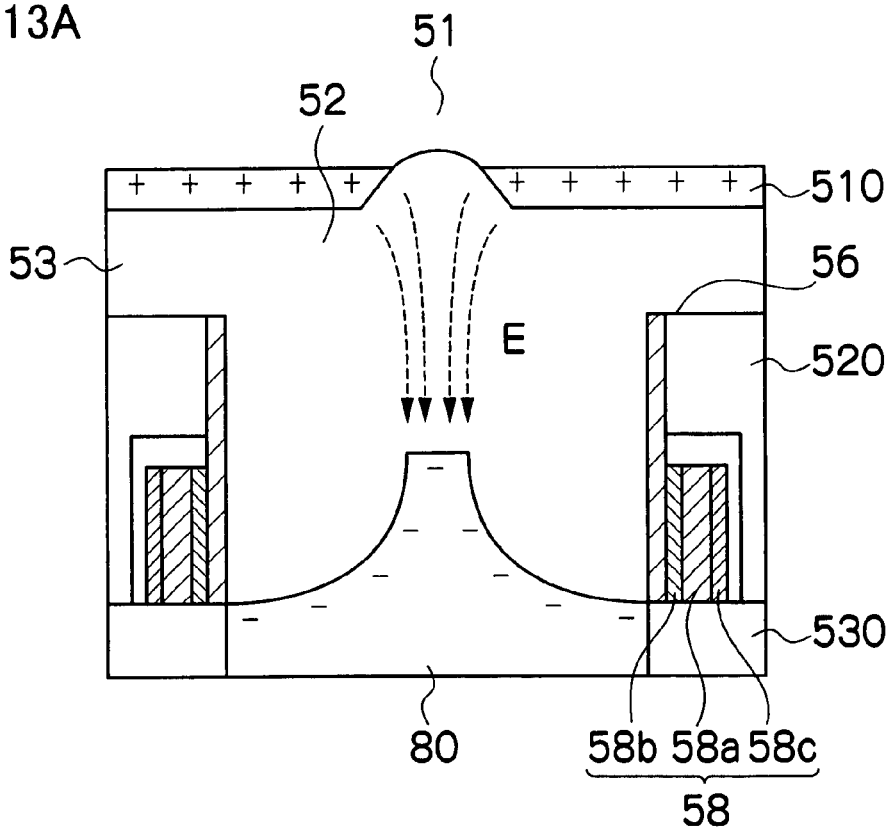
FIGS. 13A and 13B are cross-sectional diagrams of a mist ejection head according to the second embodiment of the present invention.
Figure 13B:
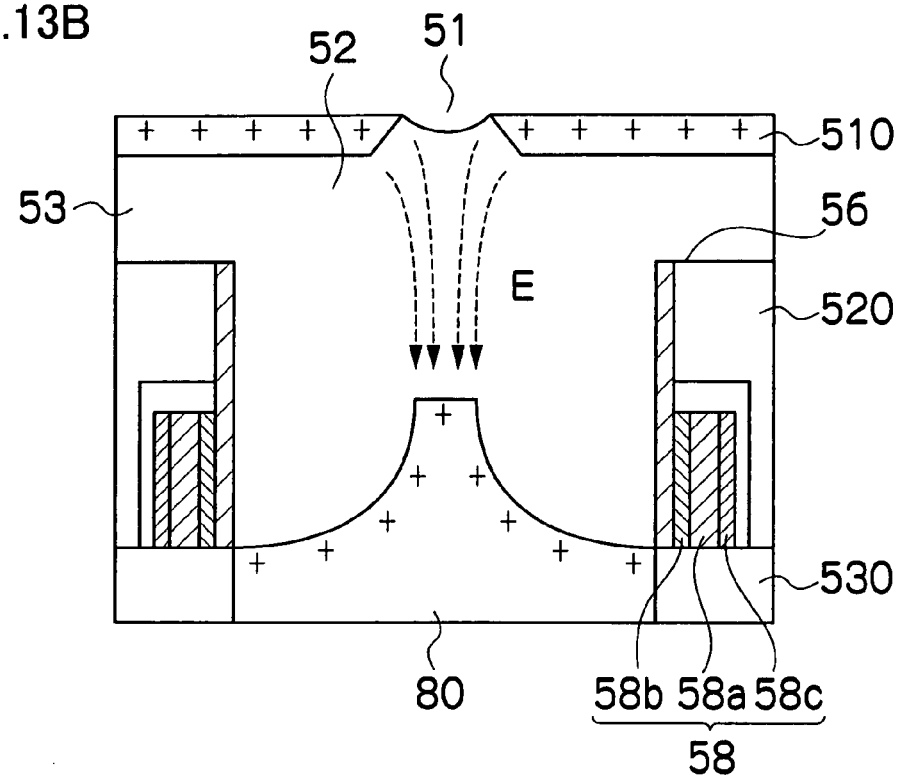

As shown in FIGS. 13A and 13B, a mist ejection head according to the present embodiment comprises: the nozzle plate 510 formed with a nozzle (ejection port) 51 which is the opening through which the mist of liquid is ejected; a liquid chamber 52 connected to the nozzle 51; a liquid supply port 53 which is the opening through which the liquid is supplied to the liquid chamber 52; a diaphragm 56 arranged on the lateral face of the liquid chamber 52; an ultrasonic wave generating element 58 which is arranged on the side of the diaphragm 56 reverse to the other side facing the liquid chamber 52, and functions as the actuator capable of generating ultrasonic waves and applying the ultrasonic waves to the liquid inside the liquid chamber 52; and a reflector 80.

The ultrasonic wave generating element 58 includes the piezoelectric body layer 58*a*, and the upper and lower electrodes 58*b* and 58*c* to which drive signals are applied from outside the mist ejection head (more specifically, from the head driver 184 in FIG. 7).

The liquid chamber 52 of the mist ejection head is defined by the nozzle plate 510 serving as the ceiling plate, the liquid chamber plate 520 having the ultrasonic wave generating element 58 and serving as the side plates, and the reflector plate 530 having the reflector 80 and serving as the bottom plate.

In the ultrasonic wave generating element 58, the piezoelectric body layer 58*a* is made of lead zirconate titanate (PZT), and the upper and lower electrodes 58*b* and 58*c* are made of nickel (Ni). Moreover, the diaphragm 56 is made of polyimide (PI).

The ultrasonic waves generated by the ultrasonic wave generating element 58 are introduced into the liquid inside the liquid chamber 52 through the diaphragm 56, and the ultrasonic waves progress as parallel planar waves towards the nozzle plate 510. By means of these planar waves, surface tension waves are established on the free surface (meniscus) of the liquid in the nozzle 51. These surface tension waves are dependent on the surface tension of the liquid.

FIG. 13A is a diagram showing a state where the meniscus surface in the nozzle 51 has been changed to a convex shape, by the ultrasonic wave generating element 58. In this case, an electric field is applied in such a manner that a positive charge is applied to the nozzle plate 510 and a negative charge is applied to the reflector 80, and consequently a force acts in a direction in such a manner that the liquid surface (meniscus surface) of the liquid in the vicinity of the nozzle 51 approaches a planar shape (the radius of curvature is increased).

FIG. 13B is a diagram showing a state where the meniscus in the nozzle 51 has been changed to a concave shape, by the ultrasonic wave generating element 58. In this case, an electric field is applied in such a manner that a positive charge is applied to the nozzle plate 510 and a positive charge is also applied to the reflector 80. Consequently, a force acts in a direction in such a manner that the liquid surface (meniscus surface) of the liquid in the vicinity of the nozzle 51 approaches a planar shape (the radius of curvature is increased).

A concave-convex vibration is generated at the meniscus surface of the liquid in the nozzle 51 by the ultrasonic wave generating element 58, and the amplitude of the concave-convex vibration becomes very large in cases of the liquid having a high viscosity. However, by altering the polarity of the electric field applied to the reflector 80 (by altering the direction of the electric field applied between the nozzle plate 510 and the reflector 80) in accordance with the convex-concave state of the meniscus surface of the liquid in the nozzle 51, as in the present embodiment, then it is possible to reduce the amplitude of the convex-concave vibration of the meniscus surface of the liquid in the nozzle 51, and the apparent surface tension can be increased.

Consequently, it is possible to form a mist by means of an ultrasonic wave generating element operating at approximately 10 MHz (producing an ultrasonic wave with a frequency of 10 MHz), even in the cases of liquid having high viscosity.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist ejection head comprising:

a nozzle which ejects liquid;

a nozzle plate which has electrical conductivity and in which the nozzle is formed;

a liquid chamber connected to the nozzle;

an ultrasonic wave generating element which generates an ultrasonic wave applied to the liquid in a vicinity of the nozzle; and an electrode which is provided on a wall of the liquid chamber other than the nozzle plate, wherein an electric field applied between the nozzle plate and the electrode is controlled.

2. The mist ejection head as defined in claim 1, wherein the electric field applied between the nozzle plate and the electrode is an alternating electric field.

3. The mist ejection head as defined in claim 2, wherein a frequency of the alternating electric field is ½ of a frequency at which the ultrasonic wave generating element is driven.

4. The mist ejection head as defined in claim 1, wherein, when a meniscus surface of the liquid in the nozzle has a protrusion shape in which the meniscus surface projects from a surface of the nozzle plate in terms of a liquid ejection direction, the nozzle plate and the electrode are charged in such a manner that the nozzle plate and the electrode have opposite polarities.

5. The mist ejection head as defined in claim 1, wherein, when a meniscus surface of the liquid in the nozzle has a recess shape in which the meniscus surface retreats with respect to a surface of the nozzle plate in terms of a liquid ejection direction, the nozzle plate and the electrode are charged in such a manner that the nozzle plate and the electrode have a same polarity.

6. An image forming apparatus comprising the mist ejection head as defined in claim 1.

7. A mist ejection head comprising:

a nozzle which ejects liquid;

a nozzle plate which has electrical conductivity and in which the nozzle is formed;

a liquid chamber connected to the nozzle;

an ultrasonic wave generating element which generates an ultrasonic wave applied to the liquid in a vicinity of the nozzle; and an electrode which is provided on a wall of the liquid chamber across the liquid in the liquid chamber from the nozzle plate, wherein an electric field applied between the nozzle plate and the electrode is controlled.

8. The mist ejection head as defined in claim 7, wherein the electric field applied between the nozzle plate and the electrode is an alternating electric field.

9. The mist ejection head as defined in claim 8, wherein a frequency of the alternating electric field is ½ of a frequency at which the ultrasonic wave generating element is driven.

10. The mist ejection head as defined in claim 7, wherein, when a meniscus surface of the liquid in the nozzle has a protrusion shape in which the meniscus surface projects from a surface of the nozzle plate in terms of a liquid ejection direction, the nozzle plate and the electrode are charged in such a manner that the nozzle plate and the electrode have opposite polarities.

11. The mist ejection head as defined in claim 7, wherein, when a meniscus surface of the liquid in the nozzle has a recess shape in which the meniscus surface retreats with respect to a surface of the nozzle plate in terms of a liquid ejection direction, the nozzle plate and the electrode are charged in such a manner that the nozzle plate and the electrode have a same polarity.

12. An image forming apparatus comprising the mist ejection head as defined in claim 7.

13. A mist ejection head comprising:

a nozzle which ejects liquid;

a nozzle plate which has electrical conductivity and in which the nozzle is formed;

a liquid chamber connected to the nozzle;

an ultrasonic wave generating element which is disposed on a lateral wall of the liquid chamber that makes contact with the nozzle plate and which generates an ultrasonic wave applied to the liquid in the liquid chamber;

a reflector which has electrical conductivity and has a reflecting surface which reflects the ultrasonic wave transmitted toward a center of the liquid chamber from the ultrasonic wave generating element so as to concentrate the ultrasonic wave at a focal point located in a vicinity of the nozzle, wherein an electric field applied between the nozzle plate and the reflector is controlled.

14. The mist ejection head as defined in claim 13, wherein a cross-sectional shape of the reflecting surface of the reflector is constituted by two parabolas having a confocal point which coincides with the focal point.

15. The mist ejection head as defined in claim 13, wherein, the liquid chamber has a cylindrical shape having an axis passing through the focal point; and the reflecting surface has a protrusion shape which is formed by rotating a parabola having a central axis perpendicular to the axis of the liquid chamber, around the axis of the liquid chamber.

16. The mist ejection head as defined in claim 13, wherein the electric field applied between the nozzle plate and the reflector is an alternating electric field.

17. The mist ejection head as defined in claim 16, wherein a frequency of the alternating electric field is ½ of a frequency at which the ultrasonic wave generating element is driven.

18. The mist ejection head as defined in claim 13, wherein, when a meniscus surface of the liquid in the nozzle has a protrusion shape in which the meniscus surface projects from a surface of the nozzle plate in terms of a liquid ejection direction, the nozzle plate and the reflector are charged in such a manner that the nozzle plate and the reflector have opposite polarities.

19. The mist ejection head as defined in claim 13, wherein, when a meniscus surface of the liquid in the nozzle has a recess shape in which the meniscus surface retreats with respect to a surface of the nozzle plate in terms of a liquid ejection direction, the nozzle plate and the reflector are charged in such a manner that the nozzle plate and the reflector have a same polarity.

20. An image forming apparatus comprising the mist ejection head as defined in claim 13.

* * * * *